United States Patent [19]

Fuller et al.

[11] Patent Number: 4,848,944

[45] Date of Patent: Jul. 18, 1989

[54] PRINTER PAPER FEED MECHANISM

[75] Inventors: Douglas D. Fuller, Contoocook; Kenenth A. Boulanger, Hudson, both of N.H.

[73] Assignee: Genicom Corporation, Waynesboro, Va.

[21] Appl. No.: 910,388

[22] Filed: Sep. 22, 1986

[51] Int. Cl.[4] ..... B41J 13/10; B41J 13/08

[52] U.S. Cl. ..... 400/629; 400/641; 271/186; 271/304

[58] Field of Search ..... 400/624, 625, 629, 636.2, 400/706, 708.1, 641, 324, 325, 329, 336; 271/8, 9, 10, 109, 110, 113, 116, 242, 127, 4, 178, 636, 186, 304

[56] References Cited

U.S. PATENT DOCUMENTS

| | | | |
|---|---|---|---|
| 2,679,801 | 10/1954 | Ford et al. | 271/242 X |
| 3,949,979 | 4/1976 | Taylor et al. | 271/10 |
| 4,184,671 | 1/1980 | Sasamori | 271/18 |
| 4,222,557 | 9/1980 | Wu | 400/625 X |
| 4,262,894 | 4/1981 | Marano | 271/4 |
| 4,268,021 | 5/1981 | Rutishauser et al. | 400/636.2 X |
| 4,362,409 | 12/1982 | Endo et al. | 400/625 |
| 4,395,032 | 7/1983 | Hipp, Jr. | 271/10 |
| 4,502,805 | 3/1985 | Humbs | 400/625 X |
| 4,556,209 | 12/1985 | Tsubo | 271/10 |
| 4,560,156 | 12/1985 | Du Bois | 400/625 X |
| 4,564,187 | 1/1986 | Costa et al. | 271/9 |
| 4,594,013 | 6/1986 | Costa et al. | 400/625 |
| 4,618,134 | 10/1986 | Kawaguchi et al. | 400/625 X |
| 4,620,809 | 11/1986 | Runyi | 400/629 X |

FOREIGN PATENT DOCUMENTS

| | | | |
|---|---|---|---|
| 11272 | 1/1986 | Japan | 400/629 |

*Primary Examiner*—Edgar S. Burr
*Assistant Examiner*—James R. McDaniel
*Attorney, Agent, or Firm*—Nixon & Vanderhye

[57] ABSTRACT

The printer paper feed mechanism disclosed herein operates to transfer a sheet of paper being printed from the printing platen to an output tray above the platen by means of a plurality of resiliently surfaced rolls carried on a shaft which is journaled in arcuate slots in end plates at either end of the platen roll. When the rollers are driven in one direction, the shaft walks along the arcuate slots toward a guide which is overlaid by a sheet of paper being fed from the platen. The rollers drive that piece of paper upwardly away from the platen and into the output tray.

6 Claims, 4 Drawing Sheets

PRINTER PAPER FEED MECHANISM

BACKGROUND OF THE INVENTION

The present invention relates to cut sheet paper feeding mechanisms and more particularly to such a mechanism which will transfer a cut sheet of paper from a printing platen into an output tray located above the platen.

The present invention is an improvement of the paper feed mechanism described in a co-pending, co-assigned application by Frank Pensavecchia et al. entitled "Vertical Stand-Alone Printer", filed July 11, 1985, Ser. No. 754,068. The disclosure of said co-pending application is incorporated herein by reference.

In developing a low-cost stand-alone printer having a small footprint suitable for use with currently available personal computers, a need has arisen for a very simple, compact and yet reliable paper feed mechanism which will reliably feed a cut sheet of paper from a printing platen into an output tray or bin located above the printing platen.

Among the several objects of the present invention may be noted the provision of a paper feed mechanism which will reliably feed individual sheets of paper from a printer platen upwardly into an output tray located above the printing platen; the provision of such a mechanism which is of very compact construction; the provision of such a mechanism which does not require spring loading of components; the provision of such a mechanism which is of very compact construction; the provision of such a mechanism which is highly reliable and which requires very few parts; the provision of such a mechanism which is easily assembled and which is of very low cost. Other objects and features will be in part apparent and in part pointed out hereinafter.

SUMMARY OF THE INVENTION

Briefly, the cut sheet paper feed mechanism of the present invention is adapted for feeding individual sheets of paper from a printing platen to an output tray located above the printing platen. A horizontal output drive shaft spans the paper width and a roller shaft extends parallel to the output drive shaft. A pair of arcuate slots are provided for receiving the ends of the roller shaft, the arc of the slots being centered on the axis of the output drive shaft. At least one resiliently surfaced roller is provided on the roller shaft, the roller being in frictional engagement with the output drive shaft. A paper guide extends parallel to these shafts adjacent the resiliently surfaced roller. Accordingly, when the output drive shaft is turned in one direction, corresponding rotation of the roller shaft produced by the engagement of the resiliently surfaced roller with the output drive shaft causes the roller shaft to walk toward the guide along the slots and causes the roller to engage and drive a sheet of paper overlying the guide.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
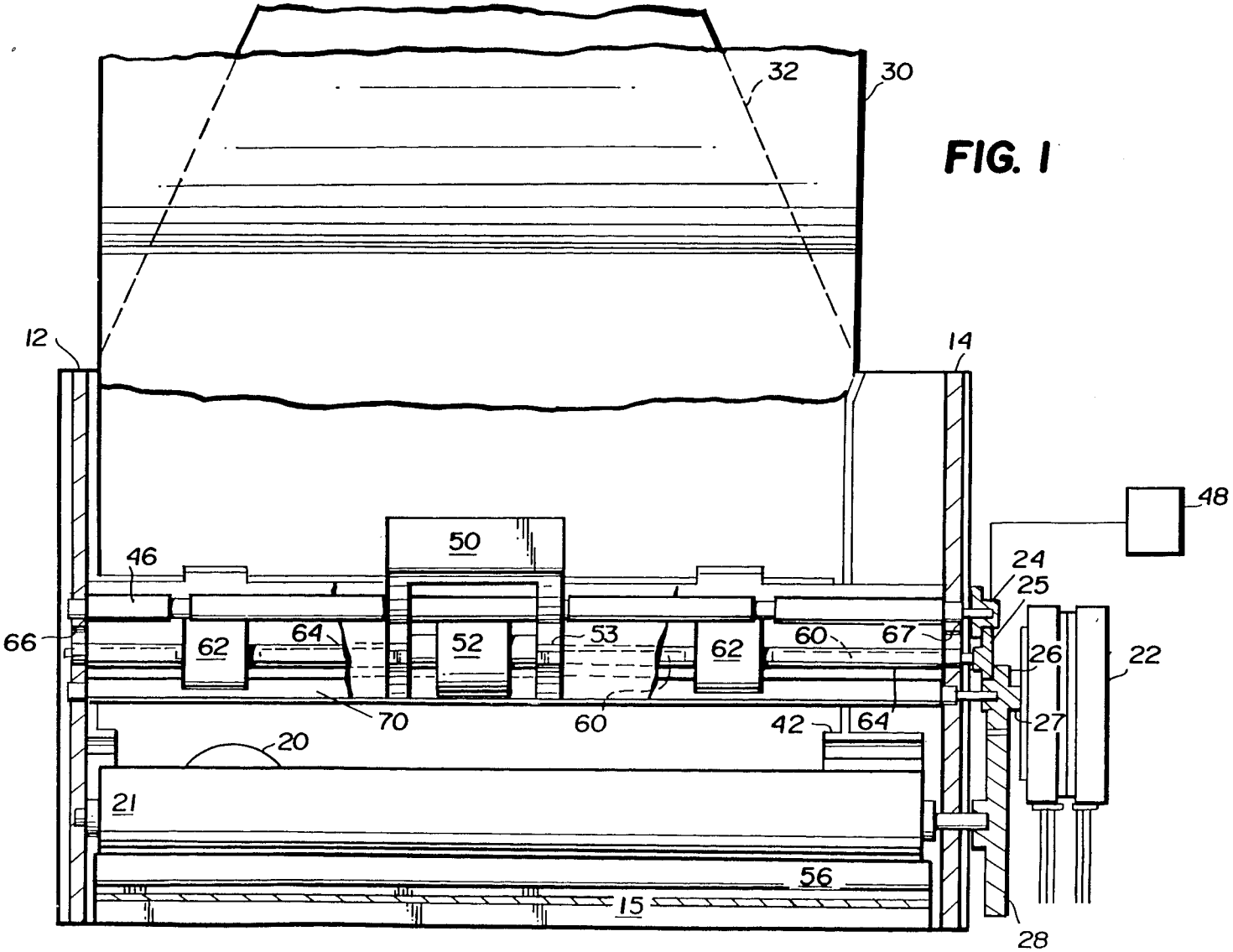
FIG. 1 is a front view of the internal working components of a computer printer employing cut sheet paper feed mechanisms constructed in accordance with the present invention.
Figure 2:
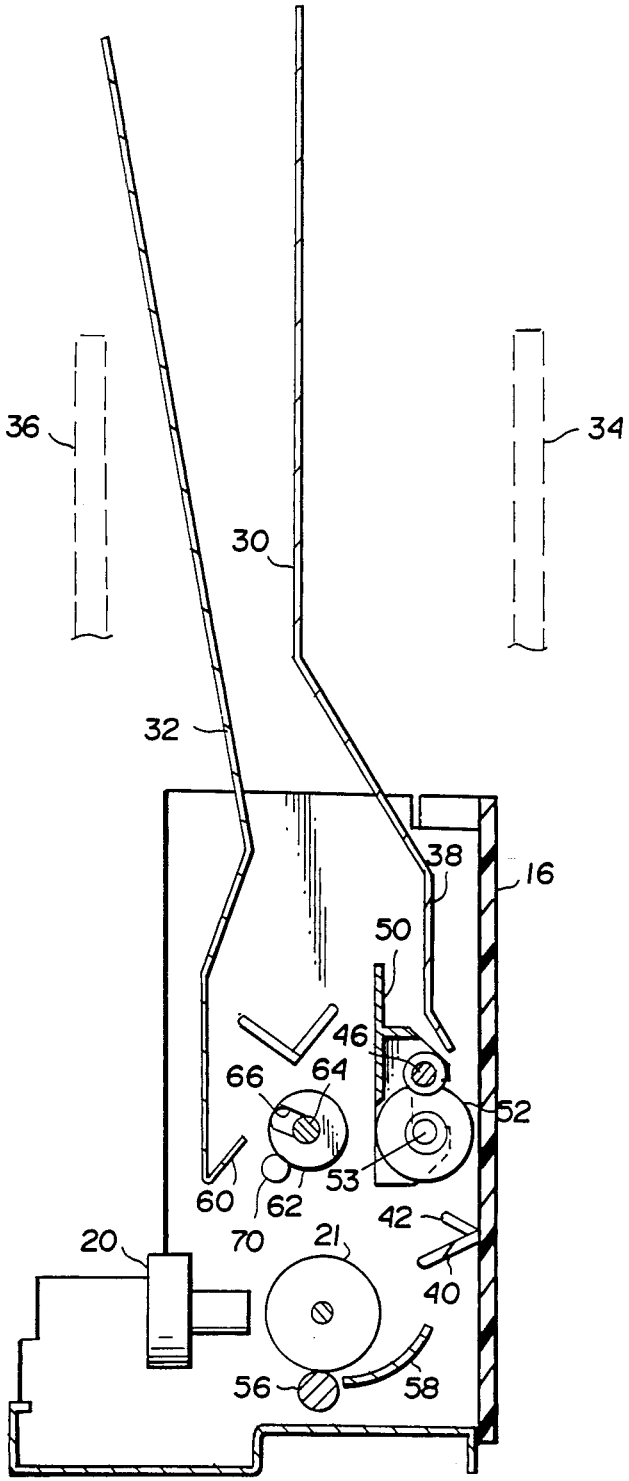
FIG. 2 is a side view, largely in section, of the printer of FIG. 1.

Referring now to FIGS. 1 and 2, it may at the outset be pointed out that the various drive shafts and feed rollers described hereinafter extend between a pair of end plates in which the drive shafts in particular are journaled. These end plates are designated in FIG. 1 by reference characters 12 and 14. The end plates themselves are mounted on a base plate 15 which also carries a laterally transversing printing mechanism, designated generally by reference character 20. Printing mechanism 20 may be of any appropriate type, e.g. of the dot matrix pin printer variety or may be a so-called bubble jet printhead. Sheets of paper which are to be printed are carried past the printing mechanism by a roll platen 21. A pressure roller 56 is provided for clamping paper to the platen roll and a guide 58 is provided for directing the leading edge of a sheet of paper into the nip between the pressure roll and the platen roll.

A bi-directional stepper motor 22 is provided for powering the drive rolls and shafts, suitable coupling and speed adjustments being provided by gears designated by reference characters 24–28.

A pair of formed panels 30 and 32 are also provided between the end plates. These panels together with the outer enclosure of the printer form input and output bins, both of which are vertically oriented. As indicated previously, FIG. 1 shows only the internal working components of the printer, the housing being omitted. In FIG. 2, the front and back panels of the outer housing are shown in dotted lines and indicated by reference characters 34 and 36 so that the basic configuration of the paper bins can be perceived.

Figure 3:
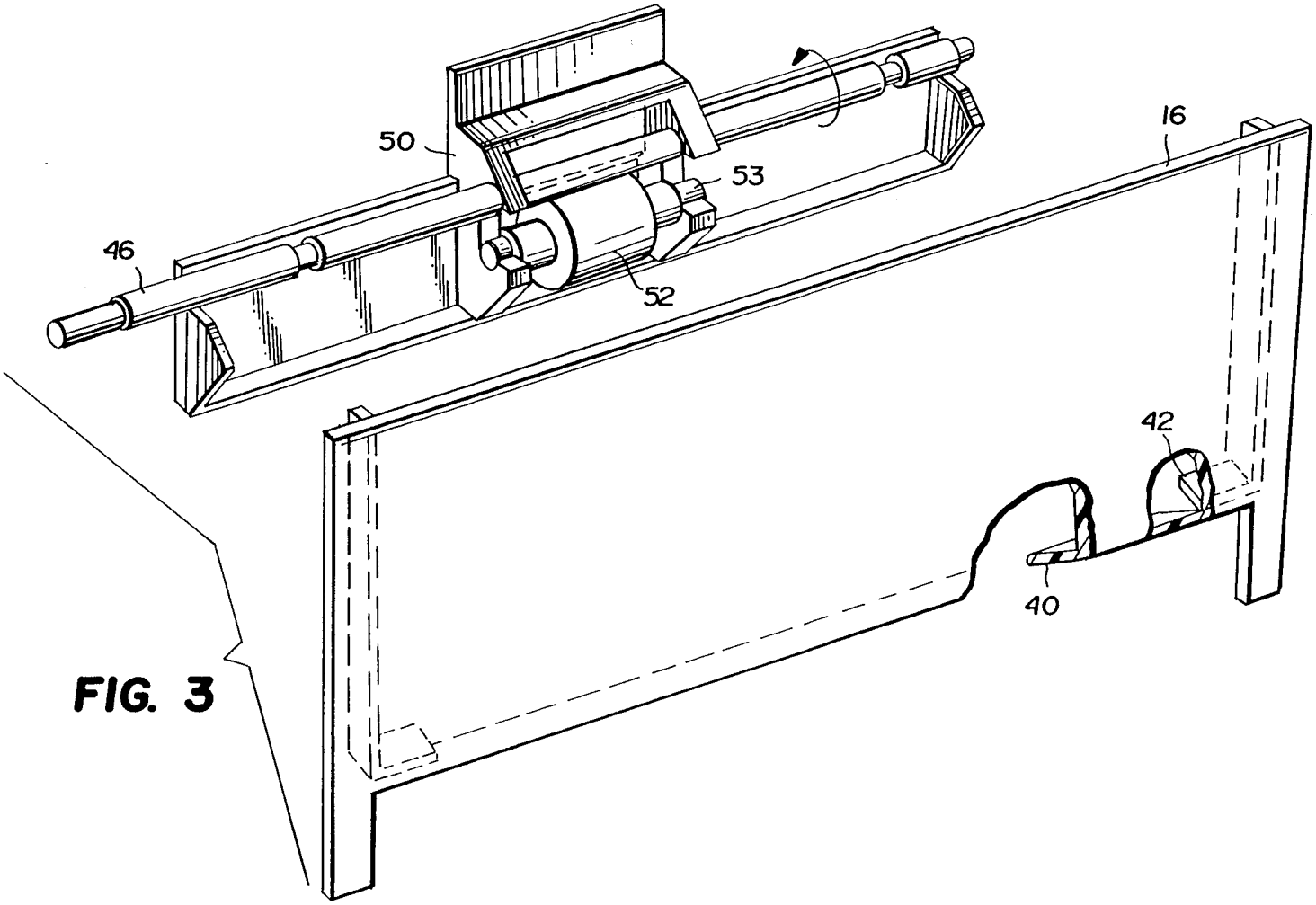
FIG. 3 is a perspective view of a swing member and associated components employed in the printer of FIGS. 1 and 2.
Figure 4:
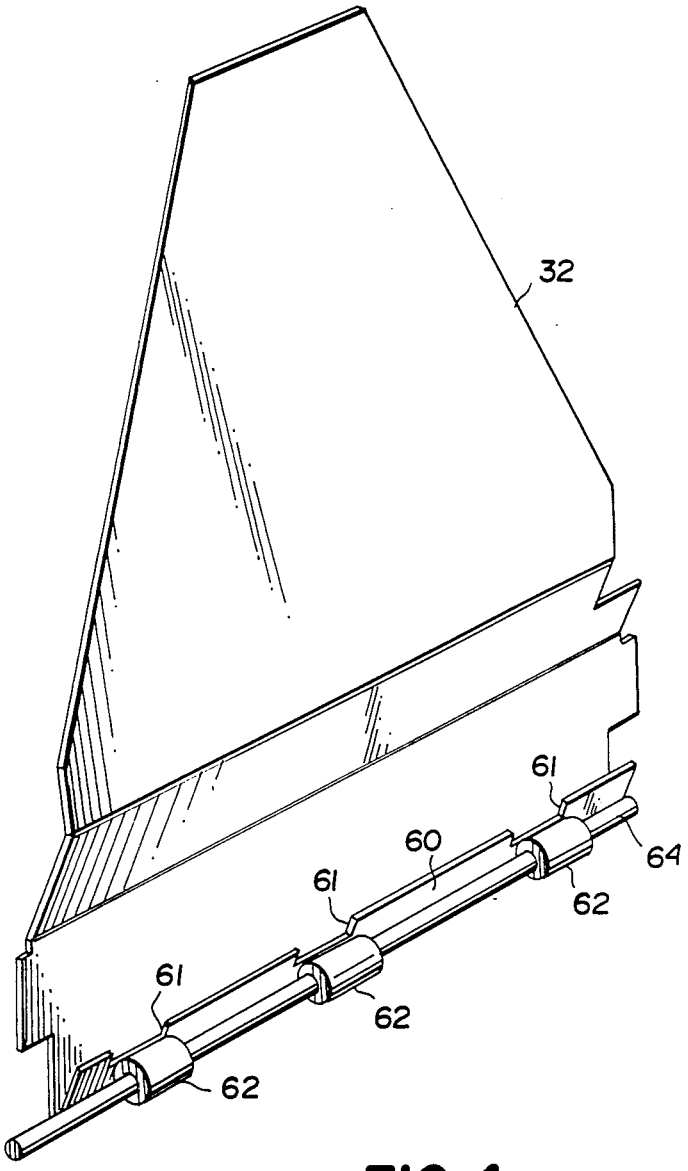
FIG. 4 is a perspective view of an output roller and guide employed in the printer of FIGS. 1 and 2.

A back plate 16 together with the paper support plate 30 form a feed tray designated generally by reference character 38. (See FIGS. 2 and 3) The back plate 16 is preferably an injection molded plastic part providing, in addition to the back panel, a bottom ledge 40 defining the bottom of the feed tray. The bottom ledge 40 is provided at each end with a corner retainer 42 which acts to induce buckling and separation of individual sheets during feeding as described hereinafter. As may be seen in FIGS. 2 and 3, the bottom ledge 40 is inclined downwardly as it extends away from the back plate 16 while the corner retainers are inclined upwardly.

An input drive shaft 46 is journaled in the end plates 12 and 14 and extends across the width of the paper generally adjacent the input pack. Input drive shaft 46 is driven through the gearing so as to rotate in the same direction as the drive roll or platen 21. However, a manually engageable clutch (not shown) is preferably interposed in the drive train for this shaft so the feed mechanism can be disengaged at will, e.g. to allow the ejection of a finished sheet without picking and starting a new sheet from the pack or to allow manual insertion of a single sheet or envelope.

An injection molded swing member, designated generally by reference character 50, is pivotally mounted on the input shaft 46 and this swing member carries a pick roller 52 which is rotatable on an axle 53. The axle 53 is parallel to the input drive shaft 46, the swing member being formed so that both effectively snap into the swing member 50 in respective notches and are retained therein.

The pick roll 52 employs a compliant, e.g. soft rubber, surface and the spacing between the axis of the pick roll and the axis of the drive shaft 46 is such that the peripheral surface of the pick roll is in frictional engagement with the drive shaft 46. The swing member and pick roll assembly can be seen in greater detail in FIG. 3.

Picking and feeding of a sheet of paper is initiated when the input drive shaft 46 is driven in a counter-clockwise direction as viewed in FIG. 2. Due to the frictional engagement between the swing member and the drive shaft 46, counter-clockwise rotation of the shaft 46 causes the swing member 50 to carry the pick roll 52 to the right so that it engages the front (leftmost) sheet of a pack of paper in the feed tray. Once initial engagement has occurred, the driving of the pick roll 52 by the drive shaft 46 will cause a progressive wedging engagement of the pick roller between the input drive shaft 46 and the front sheet of paper. As this force builds up, it will eventually cause the center portion of the front sheet to advance, buckling the corners of the sheet against the corner retainers 42 and causing it to separate from the rest of the pack.

As a given sheet separates from the pack and advances, it is led, by guide 58, into the nip between the platen roll 21 and pressure roll 56. While the sheet is being fed by the pick roll, however, it will be understood that the drive roll is also rotating counter-clockwise so that the advancing sheet will not actually advance into the nip but rather will buckle. Further, the back pressure will cause the advancing sheet to self-align with the platen roll 21 since the pick roll 52 is relatively centrally located with respect to the width of the paper. As is understood by those skilled in the art, this self-aligning is useful in order to assure level printing across the page.

After a time interval sufficient to allow this self-aligning process to take place, the printer controller causes the motor 22 to reverse direction. This action causes the sheet being fed to be picked up in the nip between the pressure roll 56 and platen roll 21. At the same time, due to the reverse direction of the input drive shaft 46, the swing member and pick roll are moved away from the pack so that control of the paper movement is completely transferred from the feed mechanism to the platen roll.

During printing, the position of the sheet being imprinted is under the control of the platen roll and the sheet is fed progressively in stepwise fashion to facilitate printing by the printing mechanism 20. As the leading edge of the sheet advances from the platen roll during printing, it is led, by guides (not shown), into a gap between a guide surface 60 which is formed by a lower lip on the panel member 32 and a set of output rollers 62 which are carried on a roller shaft 64.

The ends of the roller shaft 64 ride in arcuate slots 66 and 67 formed in the end plates 12 and 14. The arc of these slots is centered on the axis of an output drive shaft 70. Output shaft 70 is driven through the gearing so as to also rotate in the same direction as the platen roll 21. The output rollers 62 are provided with a compliant, e.g. soft rubber, periphery and their diameter is such that their peripheries are in frictional engagement with the output drive shaft 70.

While a sheet being printed is being advanced by the platen roll 21, the roller shaft is normally in the position shown in FIG. 2 so that the rollers 62 are spaced away from the guide surface 60. However, when printing of the sheet is completed, the motor 22 is again reversed. Thus, the output drive shaft 70 will be rotated in a counter-clockwise direction. The frictional engagement of the output rollers 62 with this shaft will cause them to rotate in a clockwise direction and the shaft 64 on which the output rollers are mounted will also be so rotated. This rotation of the roller shaft 64 will cause its axis to in effect "walk" around the outer surface of the arcuate slots 66 and 67 so that the output drive shaft 70, together with the rollers 62 will move, to the left as illustrated in FIG. 2. Accordingly, the rollers 62 will engage a sheet of paper which, at this point, will be overlying the guide surface or lip 60.

The guide surface 60 includes a series of notches 61, one for each of the rollers 62, so that a sheet of paper overlying the guide surface 60 will effectively bridge the respective notch. When the rollers 62 walk over into engagement with a sheet of paper overlying the guide surface 60, it has been found that this arrangement facilitates driving of the paper by the rollers 62. Accordingly, the sheet will be fed up and away from the printing mechanism until its lower edge clears the end of the guide surface 60 and the sheet essentially drops in the output tray. At the same time, the finished sheet is being completed, the input feed mechanism will be picking and serving to the printing mechanism a new sheet unless, of course, the clutch 48 has been disengaged as described previously.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a printer, a cut sheet paper feed mechanism, said mechanism comprising:

a horizontal output drive shaft spanning the paper width;

a roller shaft extending parallel to said output drive shaft;

means providing a pair of acuate slots for receiving the ends of said roller shaft, the arc of said slots being centered on the axis of said output drive shaft;

on said roller shaft, at least one resiliently surfaced roller which is in frictional engagement with and abutting said output drive shaft;

a paper guide extending parallel to said shafts adjacent said roller whereby when said output drive shaft is turned in one direction, corresponding rotation of the roller shaft produced by the engagement of said roller with the output drive shaft will cause the roller shaft to walk toward said guide along said slots and cause said roller to engage and drive a sheet of paper overlying said guide.

2. In a printer, a cut sheet paper feed mechanism, said mechanism comprising:

a pair of end plates, one on each side of the paper path;

a horizontal output drive shaft journaled in and extending between said end plates and spanning the paper width;

a roller shaft extending parallel to said output drive shaft, the ends of said roller shaft being received in arcuate slots in said end plates, the arc of said slots being centered on the axis of said output drive shaft;

on said roller shaft, a plurality of resiliently surfaced rolls the peripheral surfaces of which are in frictional engagement with and abutting said output drive shaft;

a paper guide extending parallel to said shafts adjacent said rollers, the guide having a plurality of shallow notches adapted to receive the peripheral surfaces of said rollers;

whereby when said output drive shaft is turned in one direction, corresponding rotation of the roller shaft produced by the engagement of said roller with the output drive shaft will cause the roller shaft to roll toward said guide along the outer edges of said slots and cause said roller to engage and drive a sheet of paper overlying said guide at said notches.

3. In a printer having a horizontally journaled roller platen and means for printing on a sheet of paper overlying said platen, a paper feed mechanism for transferring cut sheets of paper from said platen to an output tray above the platen, said mechanism comprising:

a guide providing as lip above said roller platen for guiding paper from said platen;

a roller shaft extending parallel to said lip at essentially the same height over said roller platen;

said roller shaft comprising at least one resiliently surfaced roller;

a horizontal output drive shaft parallel to said roller shaft;

means providing a pair of curved slots for receiving the ends of said roller shaft, the curve of said slots being substantially centered on the axis of said output drive shaft with said roller being in frictional engagement with said output drive shaft;

means responsive to rotation of the roller shaft in one direction produced by the frictional engagement of said roller surface with and abutting the periphery of the output drive shaft to cause the roller shaft to walk toward said lip along said slots and cause said roller means to engage and drive a sheet of paper overlying said lip so that said sheet is fed from said roller platen to said tray.

4. In a printer having a horizontally journaled roller platen and means for printing on a sheet of paper overlying said platen, a paper feed mechanism for transferring cut sheets of paper from said platen to an output tray above the platen, said mechanism comprising:

a pair of end plates, one on each side of the paper path;

an output tray defining panel having at its lower end an upwardly inclined guide providing a lip above said roller platen, said lip defining one edge of said output tray;

a roller shaft extending parallel to said lip at essentially the same height over said roller platen;

spaced along said roller shaft, a plurality of resiliently surfaced rollers;

a horizontal output drive shaft parallel to said roller shaft;

in each of said end plates, an arcuate slot for receiving a respective end of said roller shaft, the arc of said slots being centered on, the axis of said output drive shaft with said rollers being in frictional engagement with and abutting said output drive shaft;

said guide lip having a plurality of shallow notches aligned with said rollers, whereby when said output drive shaft is turned in one direction, corresponding rotation of the roller shaft produced by the engagement of said roller with the output drive shaft will cause the roller shaft to walk toward said lip along said slots and cause said roller to engage and drive a sheet of paper overlying said lip so that said sheet is fed from said roller platen to said tray.

5. In a printer, a cut sheet paper feed mechanism, said mechanism comprising:

an output drive shaft spanning the paper width;

a roller shaft extending parallel to said output drive shaft;

means providing a pair of arcuate slots for receiving the ends of said roller shaft, the arc of said slots being centered on the axis of said output drive shaft;

on said roller shaft, at least one resiliently surfaced roller which is in frictional engagement with and abutting said output drive shaft;

a paper guide extending parallel to said shafts adjacent said roller; and means for causing said roller to engage and drive a sheet of paper overlying said guide comprising means for rotating said output drive shaft in one direction, said roller being responsive to rotation of said output drive shaft for causing the roller shaft to walk toward said guide along said slots.

6. An arrangement according to claim 5 further comprising means for causing said roller to disengage and not drive a sheet of paper overlying said guide, comprising means for rotating said output drive shaft in the other direction, said roller being responsive to rotation of said output drive shaft in said other direction for causing the roller shaft to walk away from said guide along said slots.

* * * * *